US010807115B1

(12) United States Patent
Jan et al.

(10) Patent No.: US 10,807,115 B1
(45) Date of Patent: Oct. 20, 2020

(54) FIXING STRUCTURE OF SPA SPRAYER

(71) Applicant: Foresee Scientech Ltd., Xiushui Township, Changhua County (TW)

(72) Inventors: Danny Jan, Xiushui Township (TW); Cheng-Hsiung Chang, Xiushui Township (TW)

(73) Assignee: Foresee Scientech Ltd., Xiushui Township (TW)

( * ) Notice: Subject to any disclaimer, the term of this patent is extended or adjusted under 35 U.S.C. 154(b) by 7 days.

(21) Appl. No.: 16/389,063

(22) Filed: Apr. 19, 2019

(51) Int. Cl.
*A47K 3/022* (2006.01)
*B05B 15/65* (2018.01)

(52) U.S. Cl.
CPC ..... *B05B 15/65* (2018.02); *A47K 3/022* (2013.01)

(58) Field of Classification Search
CPC ..... A47K 3/022
USPC ..... 4/622, 541.6
See application file for complete search history.

(56) References Cited

U.S. PATENT DOCUMENTS 8,607,374 B2 * 12/2013 Lawyer ..... A61H 33/6063 4/541.1
10,542,847 B2 * 1/2020 Luong ..... A47C 15/004

* cited by examiner

*Primary Examiner* — Christine J Skubinna
(74) *Attorney, Agent, or Firm* — Alan D. Kamrath; Mayer & Williams PC

(57) ABSTRACT

A fixing structure of a spa sprayer, the spa sprayer comprises: a body, a holder, and a water spray unit. The body includes an insertion segment, a connection segment, a motor, a holder, an annular positioning section, multiple fixers, and multiple bolts. The holder has multiple orifices, the annular positioning section has multiple seats and a receiving groove, the multiple seats has a plurality of recesses, and each of the multiple seats has two opposite notches. Each of the multiple fixers includes a rotation element, a drive element, and a first rotary shaft. The rotation element has a rotatable coupling portion and an abutting portion. The rotatable coupling portion has a second rotary shaft, and the rotatable coupling portion has two opposite first apertures. The drive element has a second aperture and a threaded aperture. The water spray unit is fixed on the holder of the body.

7 Claims, 16 Drawing Sheets

FIXING STRUCTURE OF SPA SPRAYER

BACKGROUND OF THE INVENTION

Field of the Invention

The present invention relates to a spa sprayer, and more particularly to a fixing structure of the spa sprayer which is fixed and removed easily and quickly.

Description of the Prior Art

A foot spa tub has a conventional spa sprayer mounted on a peripheral wall thereof, and water is sprayed out of the conventional spa sprayer after being suctioned from the foot spa tub and being pressurized by the conventional spa sprayer. In addition, the water is swirled forcefully to enhance blood circulation and metabolism of feet of a user.

The conventional spa sprayer is mounted on fixing orifices of the peripheral wall of the foot spa tub by inserting bolts through the conventional spa sprayer and the fixing orifice of the peripheral wall, and the bolts are locked with nuts respectively. However, a size of the foot spa tub is too large to mount the conventional spa sprayer by two people. For example, the bolts are inserted through a front face of the foot spa tub by one person, and the nuts are locked with the bolts on a back face of the foot spa tub by another person, thus mounting the conventional spa sprayer on the foot spa tub troublesomely and increasing installation and maintenance costs.

With reference to FIG. 12, a conventional spa sprayer A2 contains a body 80, and the body 80 includes an insertion segment 80A, a connection segment 80B relative to the insertion segment 80A, a motor 81, a holder 82, an annular positioning section 83 defined between the motor 81 and the holder 82, multiple fixers 84, and multiple bolts 85.

The holder 82 is mounted on the connection segment 80B and has a plurality of orifices 821 defined thereon and passing through the annular positioning portion 83, the holder 82 further has a waterproof washer 822 arranged on a connection area of the holder 82 and the annular positioning portion 83.

The annular positioning section 83 has multiple slide grooves 831 corresponding to the multiple orifices 821 respectively and has multiple receiving grooves 832 away from the holder 82 and passing through the multiple slide grooves 831 individually. The multiple slide grooves 831 have a plurality of tilted guide portions 833 extending to holder 82 from the multiple receiving grooves 832 respectively.

Each of the multiple fixers 84 have a sliding portion 841 formed on a first end thereof, a retaining portion 842 arranged on a second end of each fixer 84 opposite to the first end of each fixer 84, wherein the sliding portion 841 is slidably received in each of the multiple slide grooves 831, and the sliding portion 841 has a threaded orifice 8411, The multiple bolts 85 are inserted through the multiple orifices 821 of the holder 82 individually to screw with a plurality of threaded orifices 8411 of the multiple fixers 84.

The conventional spa sprayer A2 further contains a water spray unit 90 secured on an end of the holder 82 of the body 10 away from the motor 81. The water spray unit 90 includes a spraying member 91 and a lid 92 connected with the spraying member 91, wherein the lid 92 has plural inlets 921 arranged around a center thereof and has two opposite outlets 922 proximate to a peripheral side of the lid 92.

Referring to FIGS. 12-15, as desiring to mount the spa sprayer A2 on a foot spa tub, a peripheral wall 100 of the foot spa tub has a front face 100A, a back face 100B opposite to the front face 100A, and multiple holes 101 defined thereon. The multiple fixers 84 are abutted against the receiving groove 832, the insertion segment 80A of the body 80 is inserted through the multiple holes 101 of the peripheral wall 100 of the foot spa tub, and the waterproof washer 822 of the holder 82 of the body 80 contacts with the front face 100A of the peripheral wall 100. Thereafter, the multiple bolts 85 are rotated by using a tool to respectively drive the multiple fixers 84 to move toward the holder 82, wherein the multiple fixers 84 move and change their angles along the plurality of tilted guide portions 833 respectively so that the multiple fixers 84 move to a radial angle of the body 80 and moves toward the holder 82 until contacting with the back face 100B of the peripheral wall 100, hence the spa sprayer A2 is retained on the peripheral wall 100 by the multiple fixers 84 and the waterproof washer 822 of the holder 82.

However, the conventional spa sprayer is mounted by screwing the multiple bolts 85 with the plurality of threaded orifices 8411 of the multiple fixers 84 so that the multiple bolts 85 drive the multiple fixers 84 toward the holder 82, the conventional spa sprayer A2 is retained on the peripheral wall 100 of the foot spa tub, and rotations of the multiple bolts 85 are increased so as to drive a movement of the multiple fixers 84, thus fixing and removing the conventional spa sprayer inconveniently and increasing installation and maintenance costs.

The present invention has arisen to mitigate and/or obviate the afore-described disadvantages.

SUMMARY OF THE INVENTION

The primary objective of the present invention is to provide a fixing structure of a spa sprayer by which the multiple bolts are screwed with the multiple threaded apertures of the plural drive elements of the multiple fixers respectively, and the multiple bolts are rotated tightly to respectively drive the plural drive elements to move toward the holder, wherein the plural drive elements are rotatably connected with the plural abutting portions individually, the multiple second rotary shafts of a rotation element is rotated and slid in the plurality of recesses of the multiple seats respectively, such that the plural drive elements individually drive the plural abutting portions of the rotation element to rotatably move toward the holder, thus retaining the spa sprayer on the peripheral wall of the foot spa tub, wherein the plural abutting portions of the rotation element is rotatably moved quickly to reduce rotations of the multiple bolt, thus fixing and removing the spa sprayer easily and quickly and decreasing installation and maintenance costs.

A fixing structure of a spa sprayer provided by the present invention contains: a body, a holder, and a water spray unit.

The body includes an insertion segment, a connection segment relative to the insertion segment, a motor, a holder, an annular positioning section defined between the motor and the holder, multiple fixers, and multiple bolts.

The holder is mounted on the connection segment of the body and has a plurality of orifices defined on the holder and passing through the annular positioning portion, the annular positioning section has multiple seats corresponding to the multiple orifices respectively and has a receiving groove away from the holder. The multiple seats has a plurality of recesses defined on middles thereof respectively, and each of the multiple seats has two opposite notches defined on two sides thereof, the multiple fixers is fixed on the multiple seats of the annular positioning section individually, each of the multiple fixers includes a rotation element, a drive element, and a first rotary shaft.

The rotation element has a rotatable coupling portion and has an abutting portion bending from the rotatable coupling portion, the rotatable coupling portion has a second rotary shaft arranged on an end thereof away from the abutting portion, and the rotatable coupling portion has two opposite first apertures defined between the second rotary shaft and the abutting portion.

The drive element has a second aperture and a threaded aperture, and the drive element is secured between the two opposite first apertures.

The first rotary shaft is inserted through the two opposite first apertures and the second aperture of the drive element to rotatably connect with the drive element and the rotation element. The second rotary shaft of the rotation element is rotatably connected with the two opposite notches of each seat so as to rotate and slide in the two opposite notches, the multiple bolts are inserted through the plurality of orifices of the holder to screw with multiple threaded apertures of plural drive elements of the multiple fixers respectively.

The water spray unit is fixed on the holder of the body.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
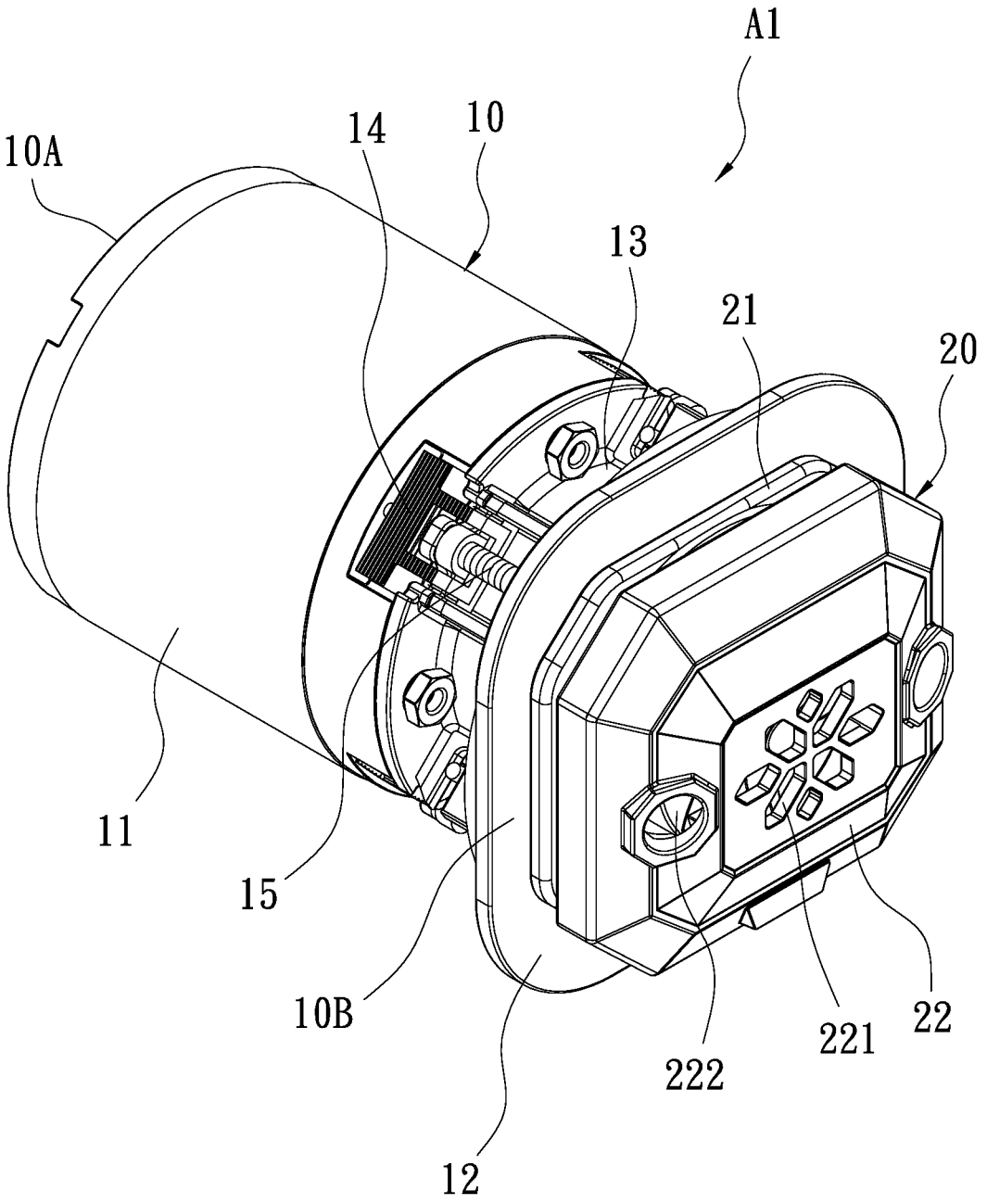
FIG. 1 is a perspective view showing the assembly of a fixing structure of a spa sprayer according to a preferred embodiment of the present invention.
Figure 2:
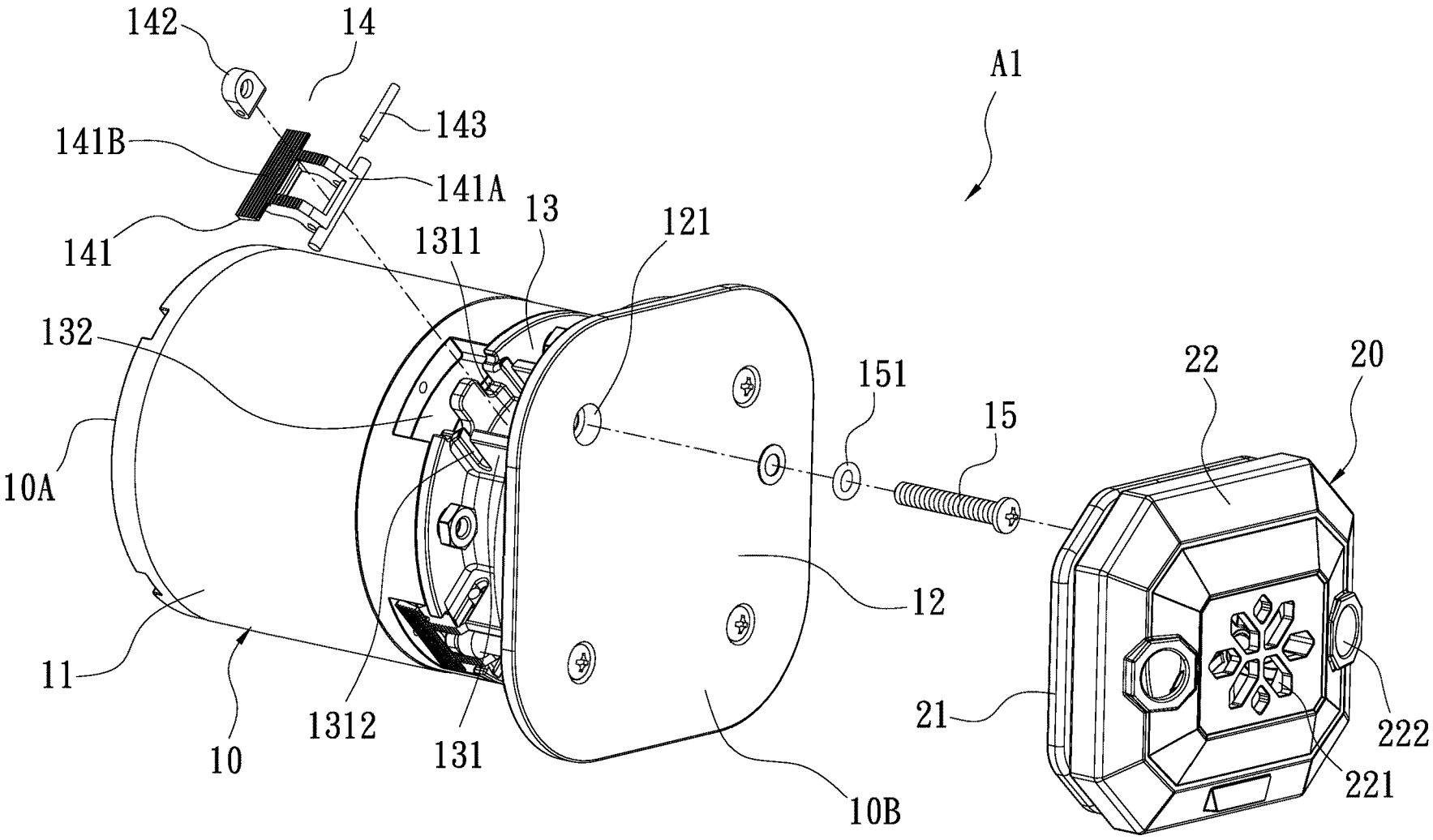
FIG. 2 is a perspective view showing the exploded components of the fixing structure of the spa sprayer according to the preferred embodiment of the present invention.
Figure 3:
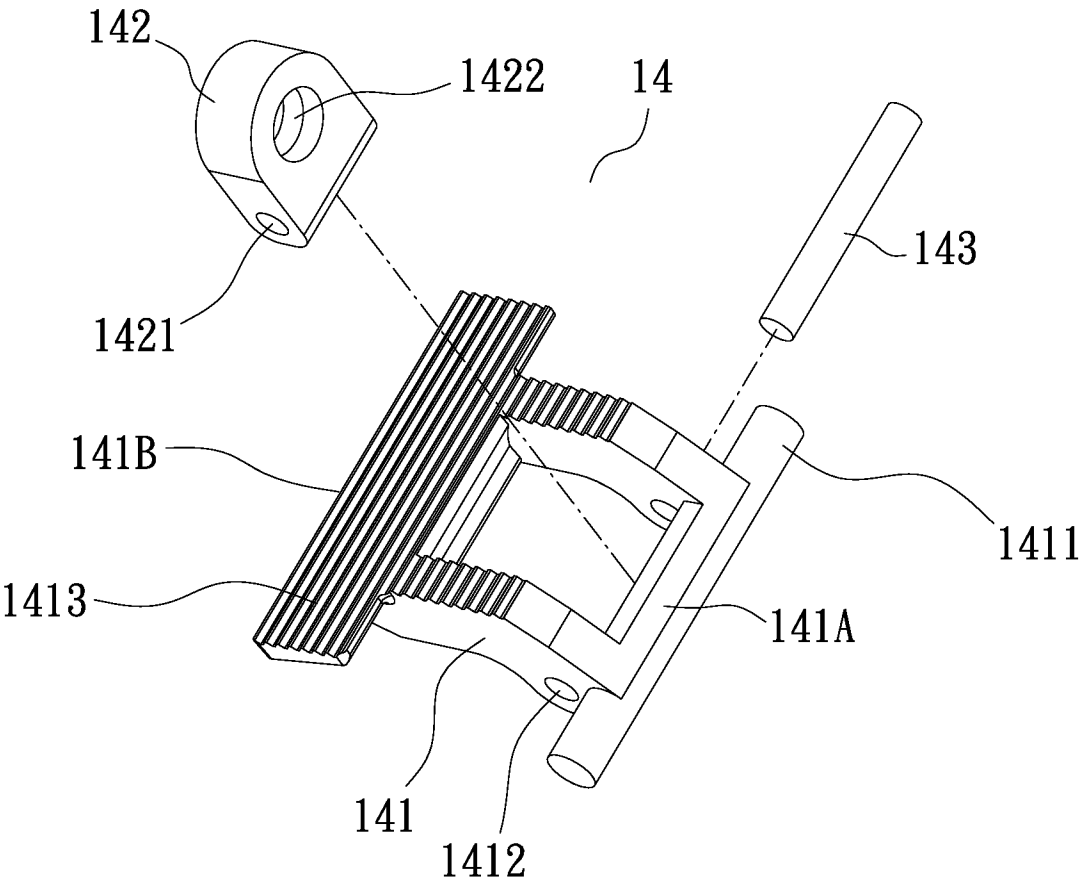
FIG. 3 is a perspective view showing the exploded components of a part of the fixing structure of the spa sprayer according to the preferred embodiment of the present invention.
Figure 4:
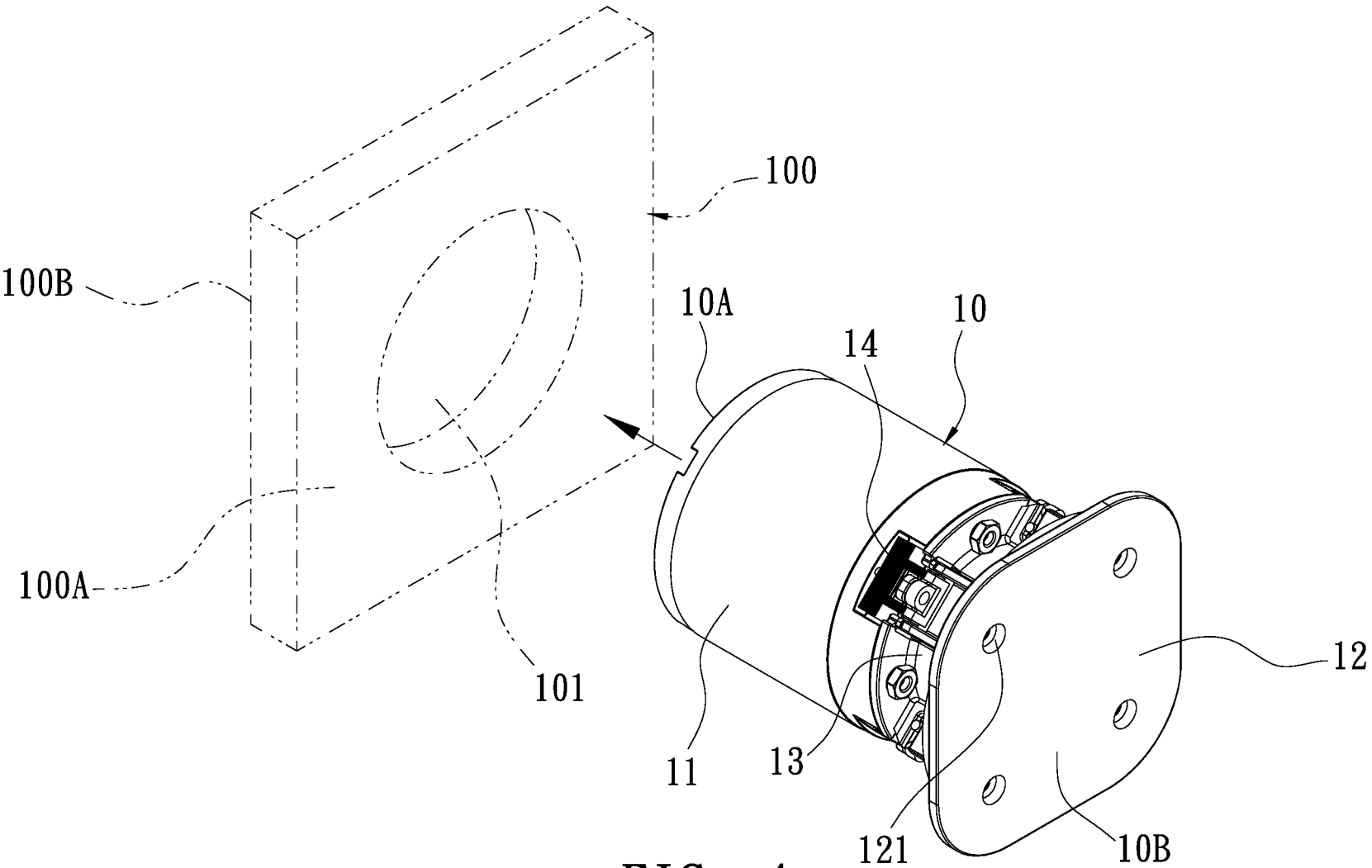
FIG. 4 is a perspective view showing the application of the fixing structure of the spa sprayer according to the preferred embodiment of the present invention.
Figure 5:
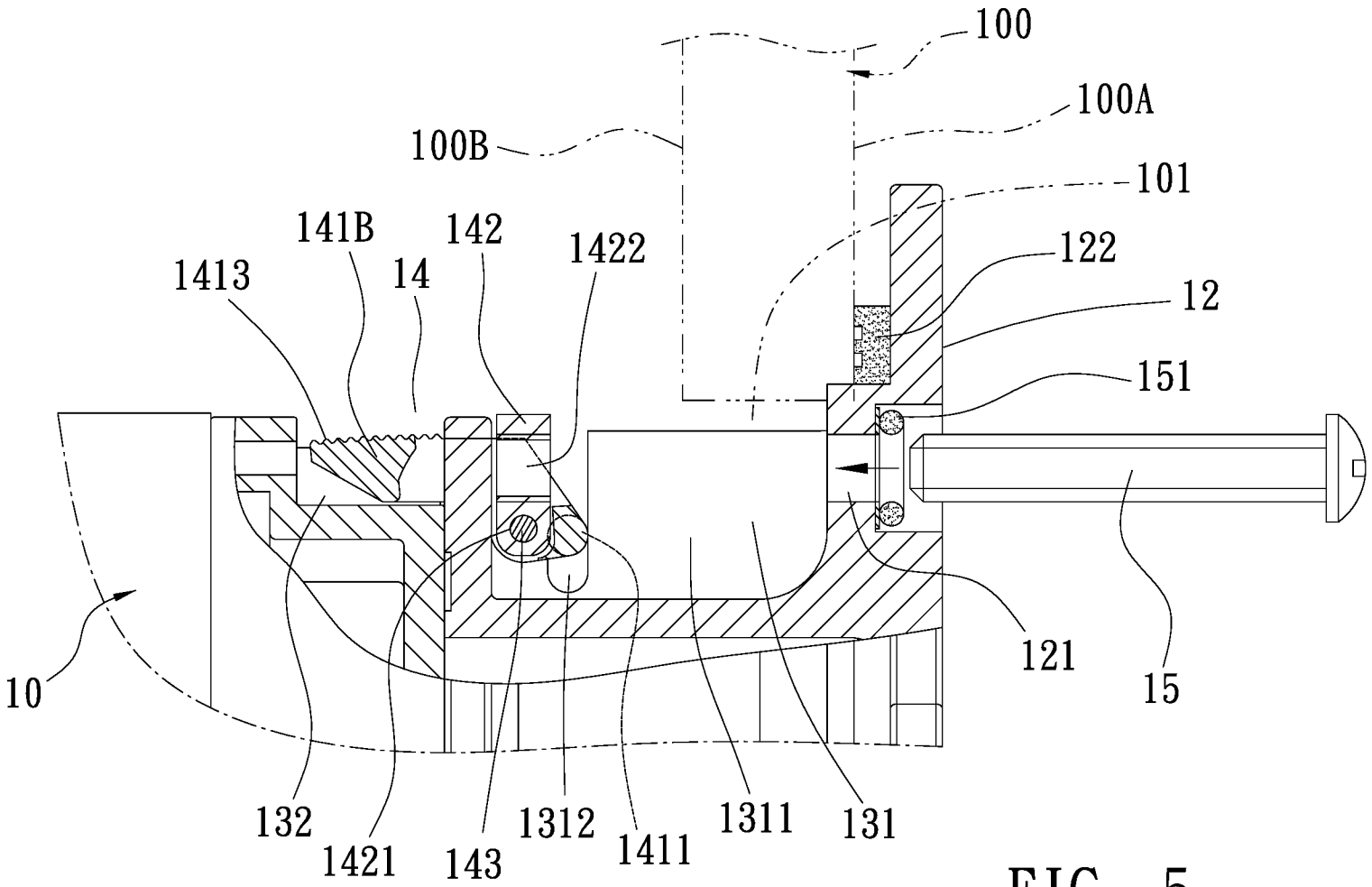
FIG. 5 is a cross sectional view showing the installation of the fixing structure of the spa sprayer according to the preferred embodiment of the present invention.
Figure 6:
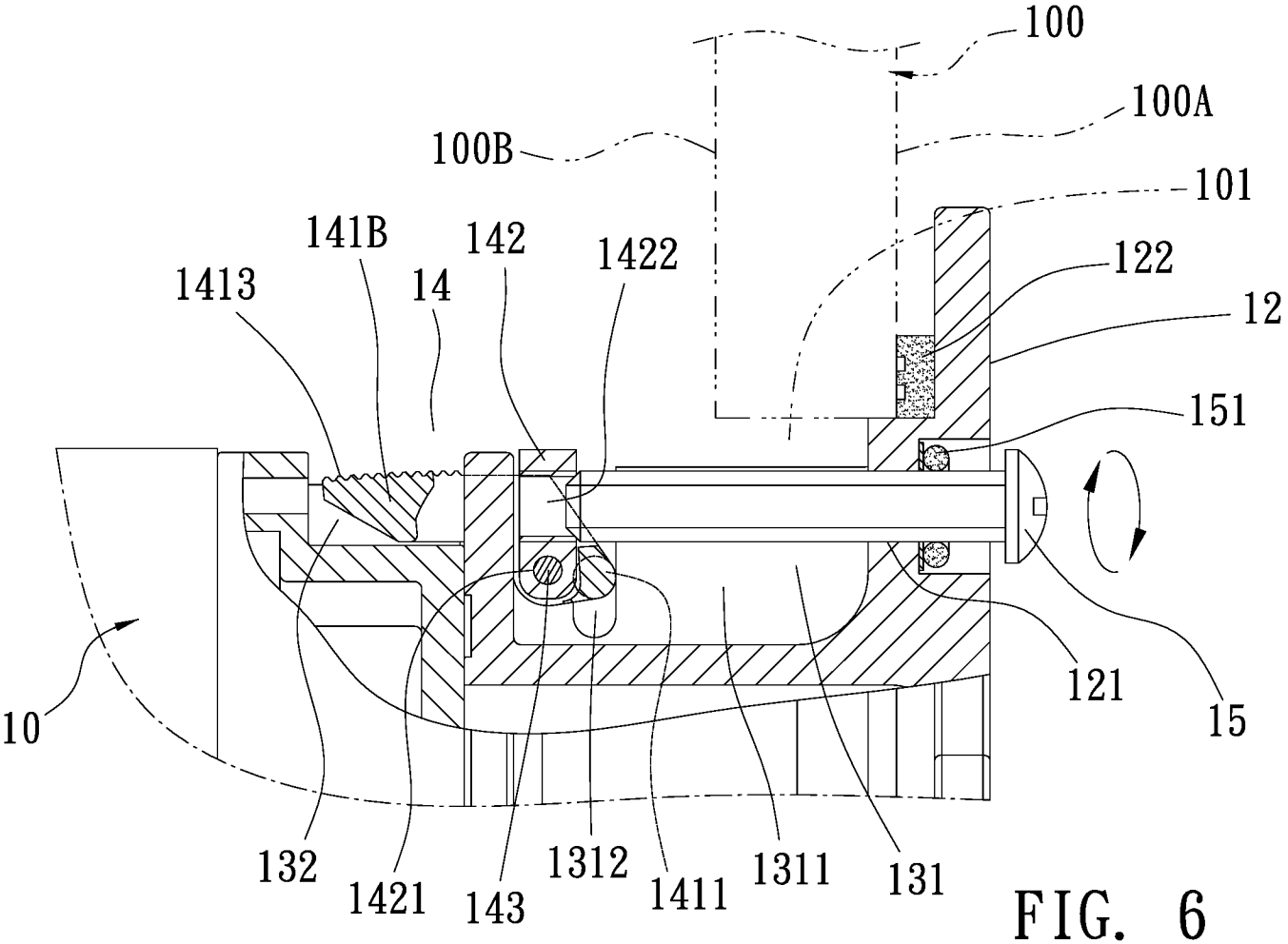
FIG. 6 is another cross sectional view showing the installation of the fixing structure of the spa sprayer according to the preferred embodiment of the present invention.
Figure 7:
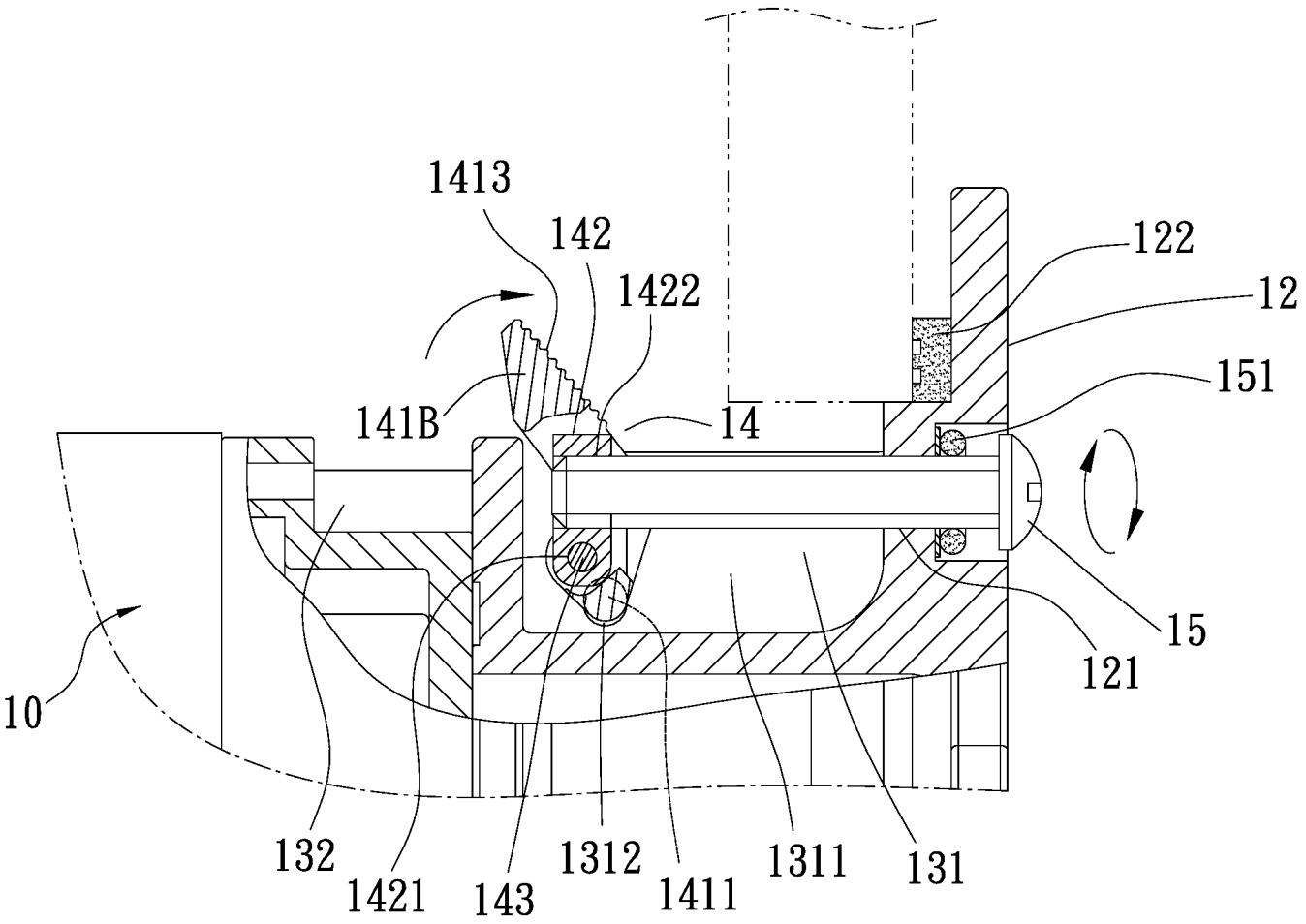
FIG. 7 is also another cross sectional view showing the installation of the fixing structure of the spa sprayer according to the preferred embodiment of the present invention.
Figure 8:
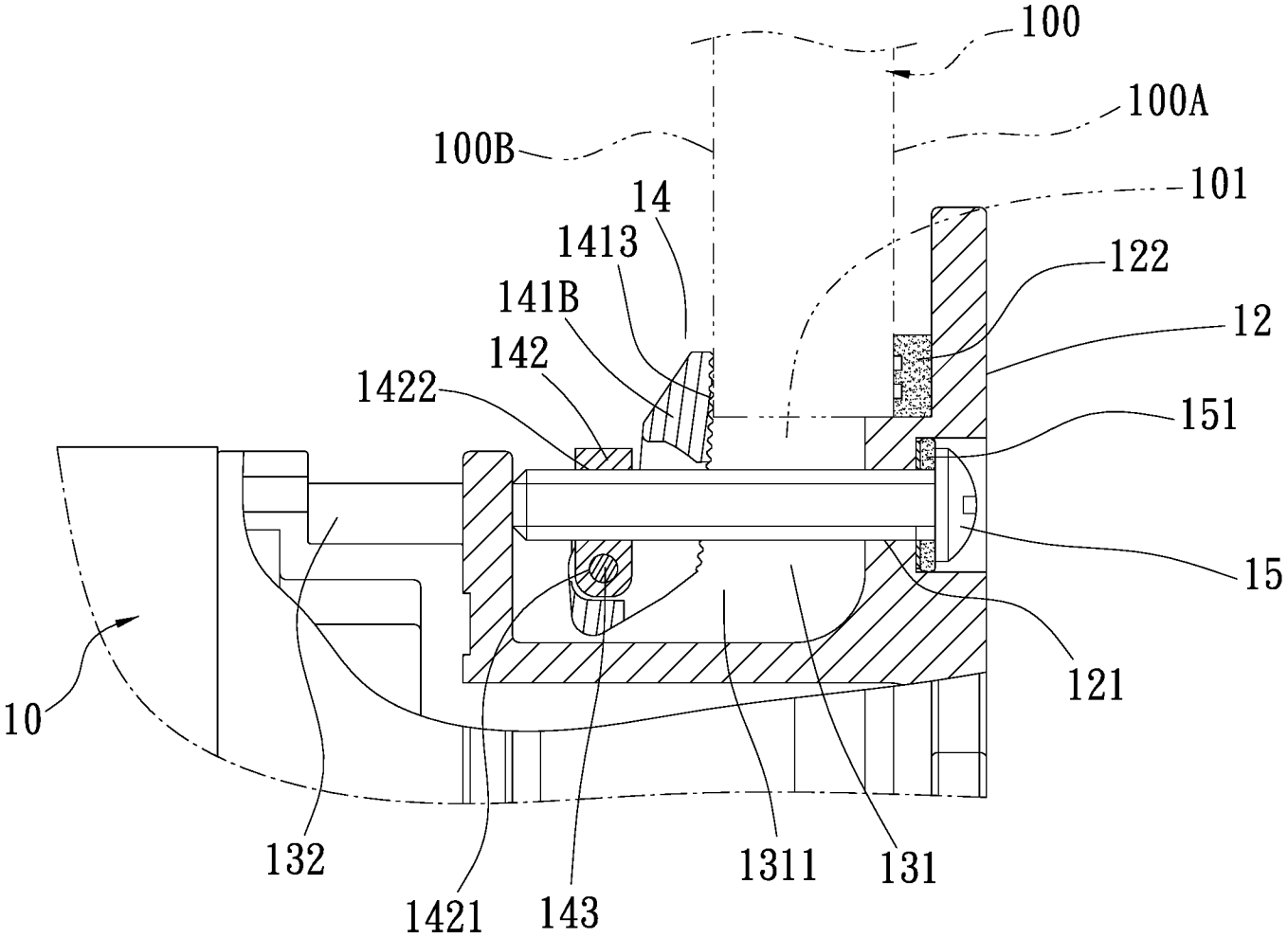
FIG. 8 is still another cross sectional view showing the installation of the fixing structure of the spa sprayer according to the preferred embodiment of the present invention.
Figure 9:
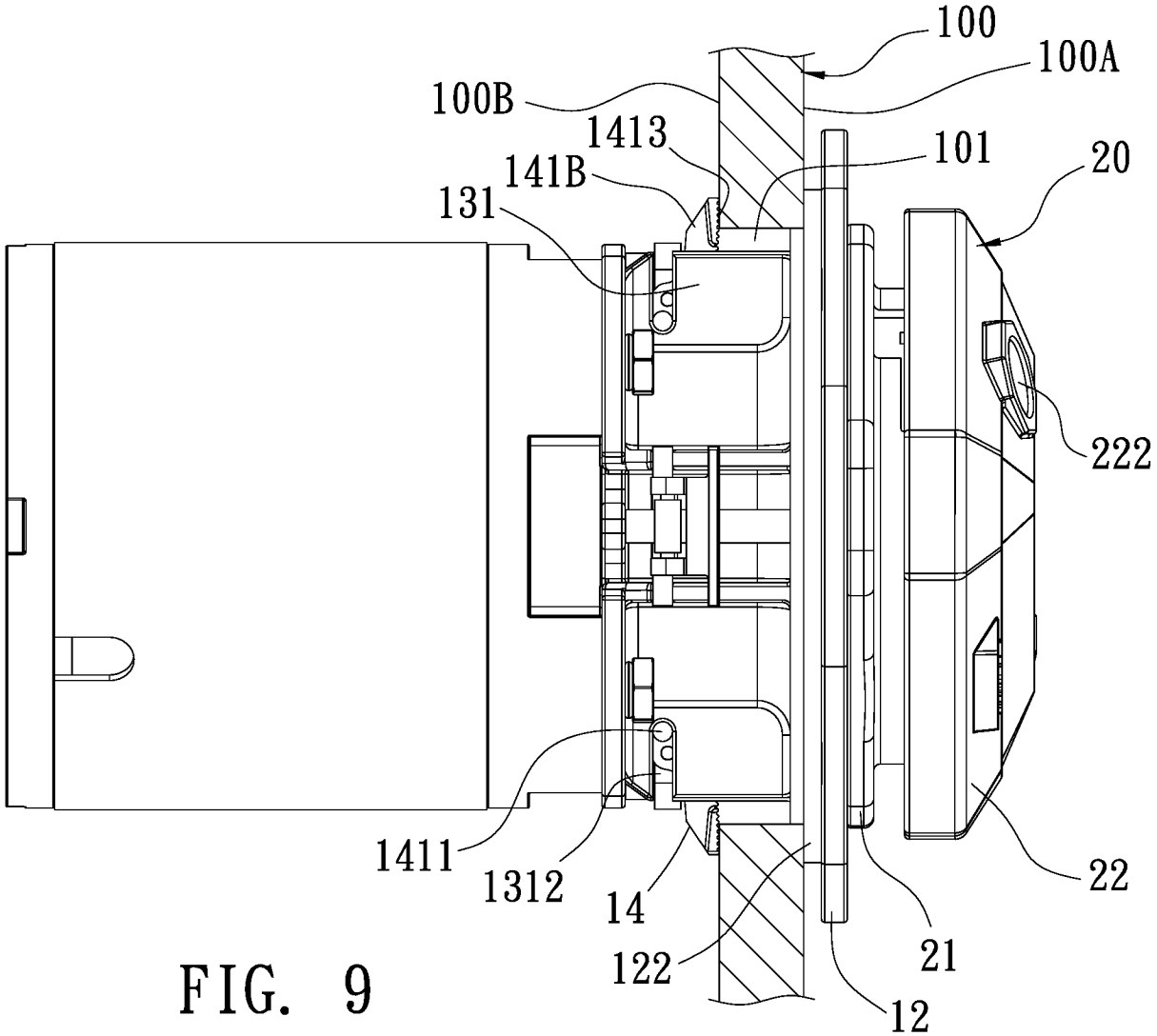
FIG. 9 is a side plan view showing the installation of the fixing structure of the spa sprayer according to the preferred embodiment of the present invention.
Figure 10:
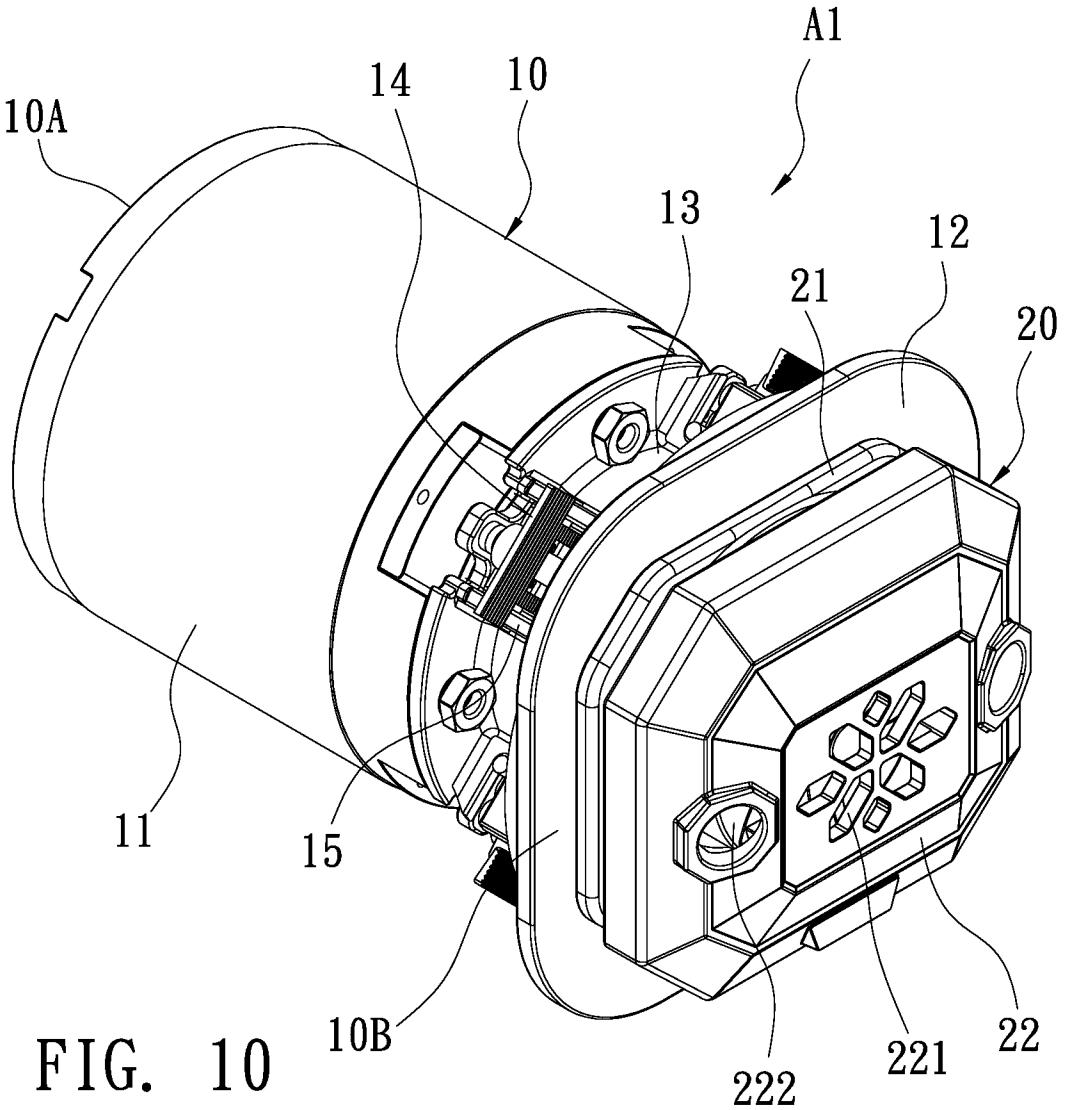
FIG. 10 is another perspective view showing the application of the fixing structure of the spa sprayer according to the preferred embodiment of the present invention.
Figure 11:
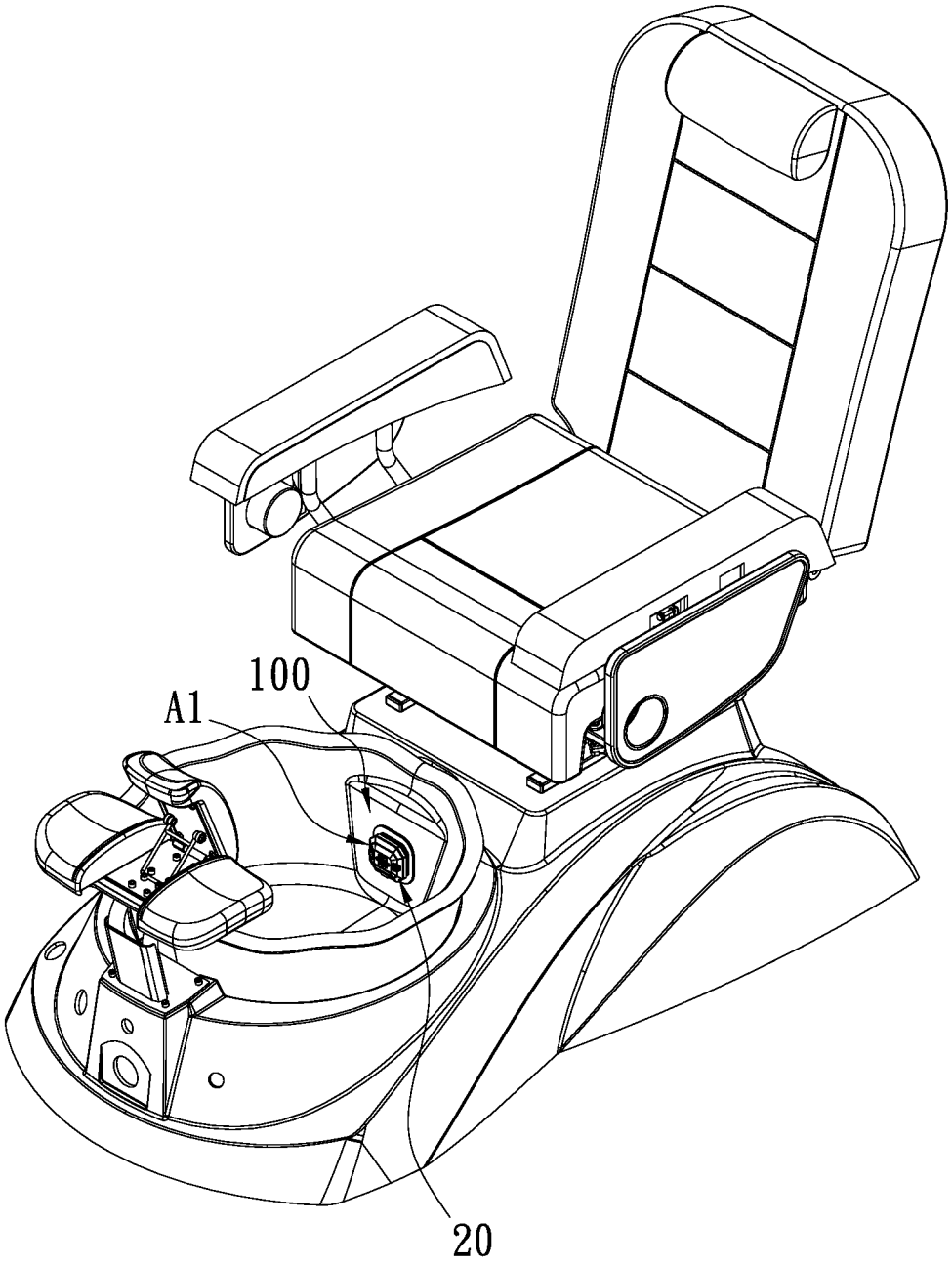
FIG. 11 is also another perspective view showing the application of the fixing structure of the spa sprayer according to the preferred embodiment of the present invention.
Figure 12:
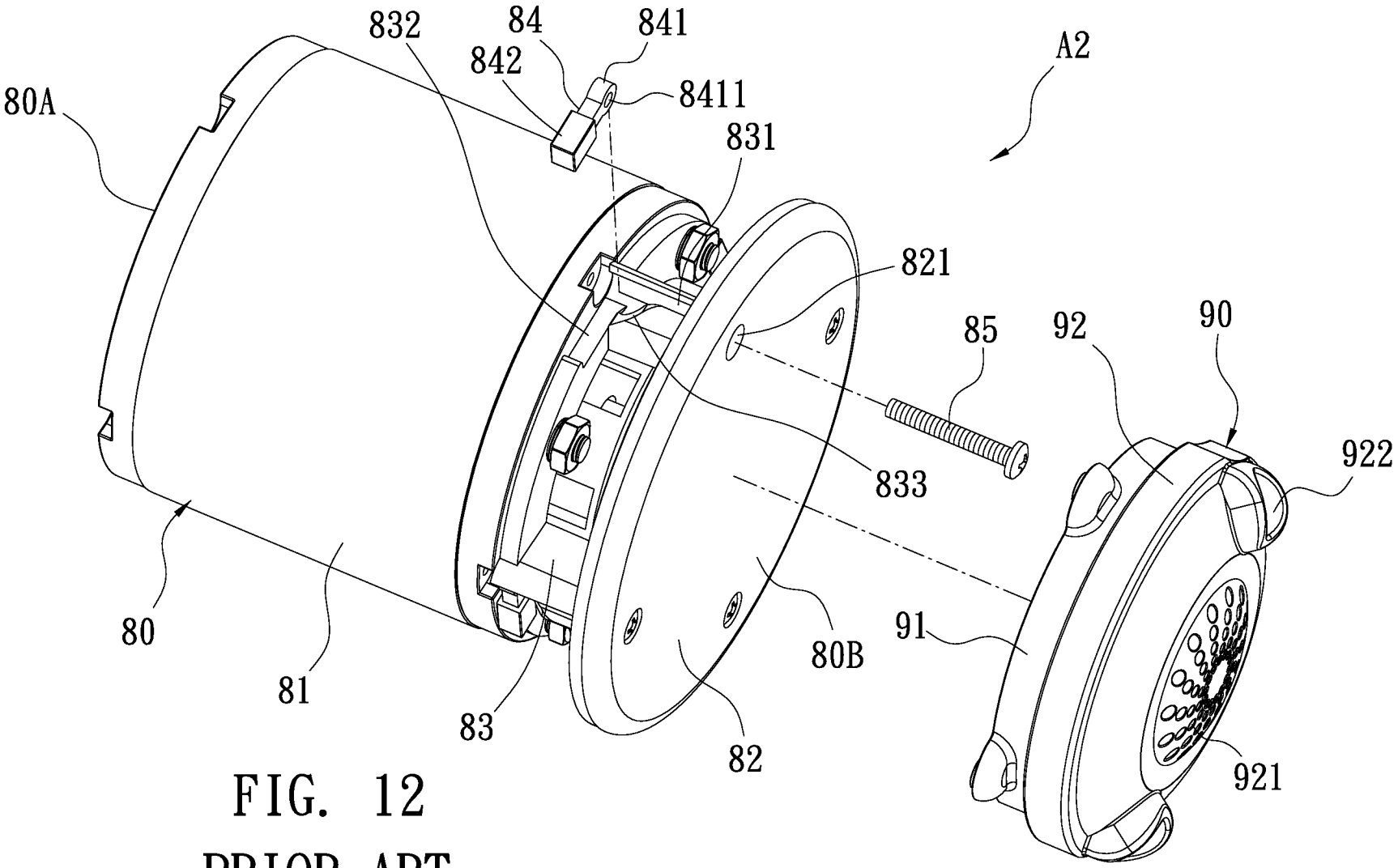
FIG. 12 PRIOR ART
FIG. 12 is a perspective view showing the exploded components of a conventional spa sprayer.
Figure 13:
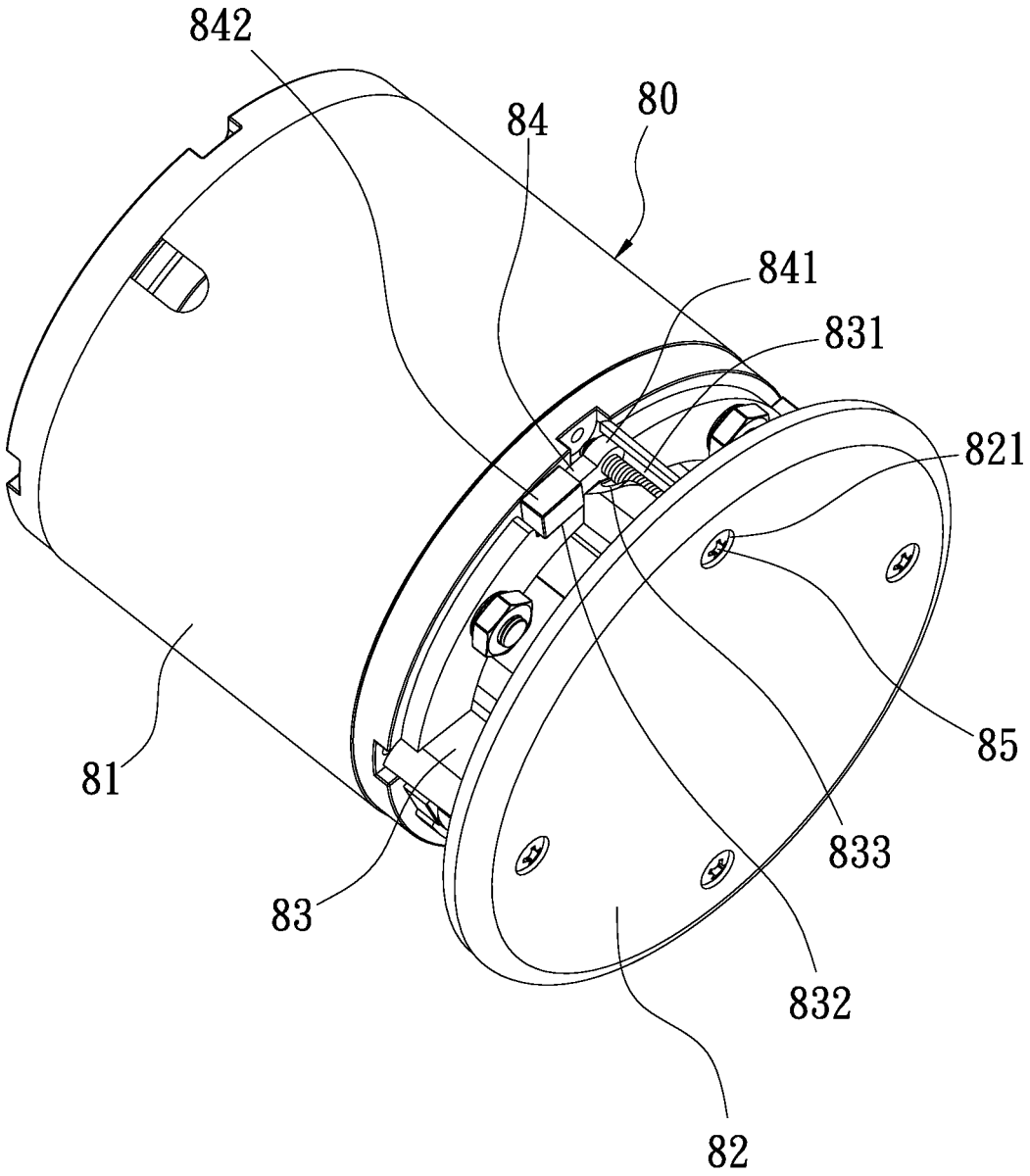
FIG. 13 PRIOR ART
FIG. 13 is a perspective view showing the installation of the conventional spa sprayer.
Figure 14:
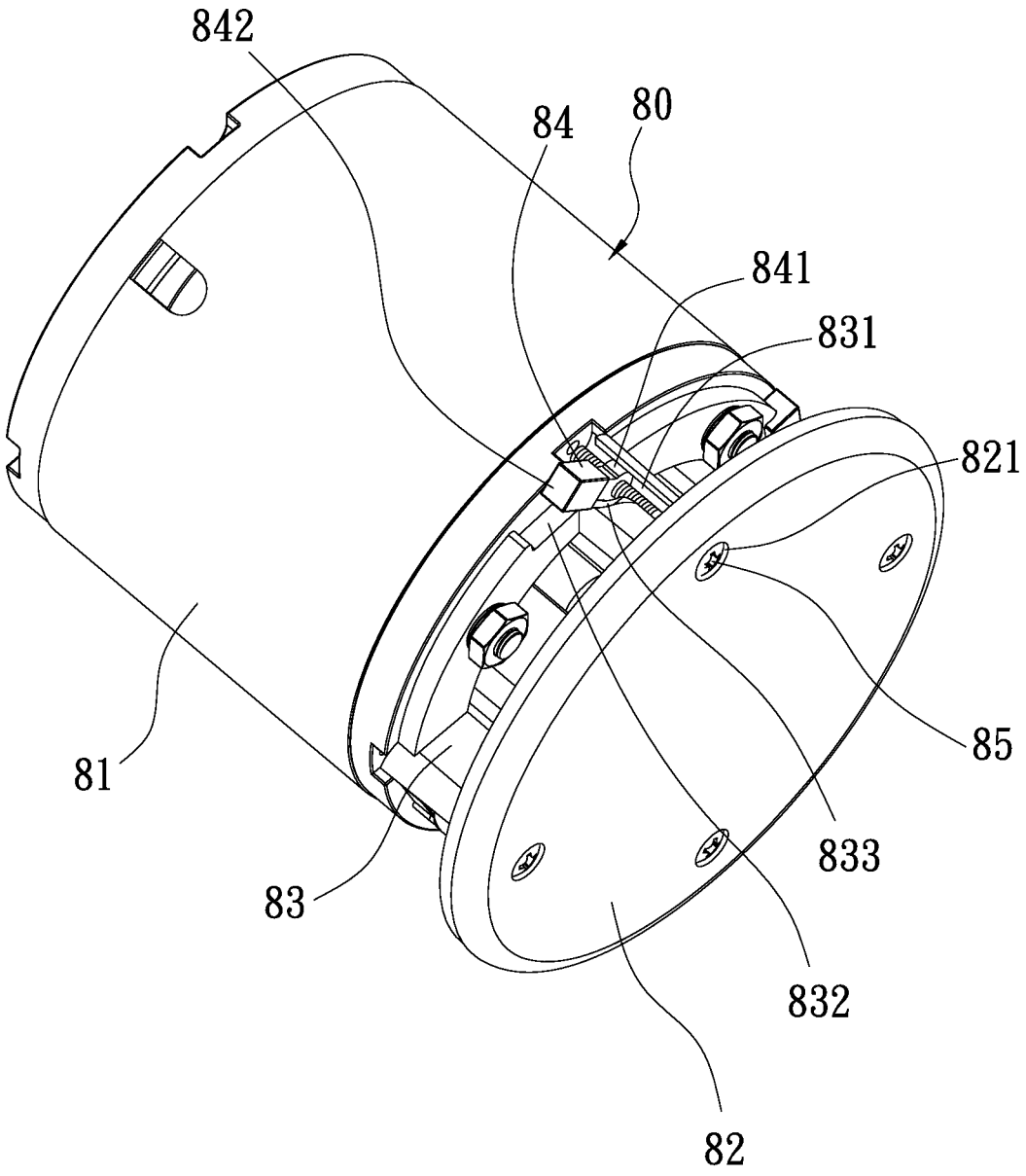
FIG. 14 PRIOR ART
FIG. 14 is another perspective view showing the installation of the conventional spa sprayer.
Figure 15:
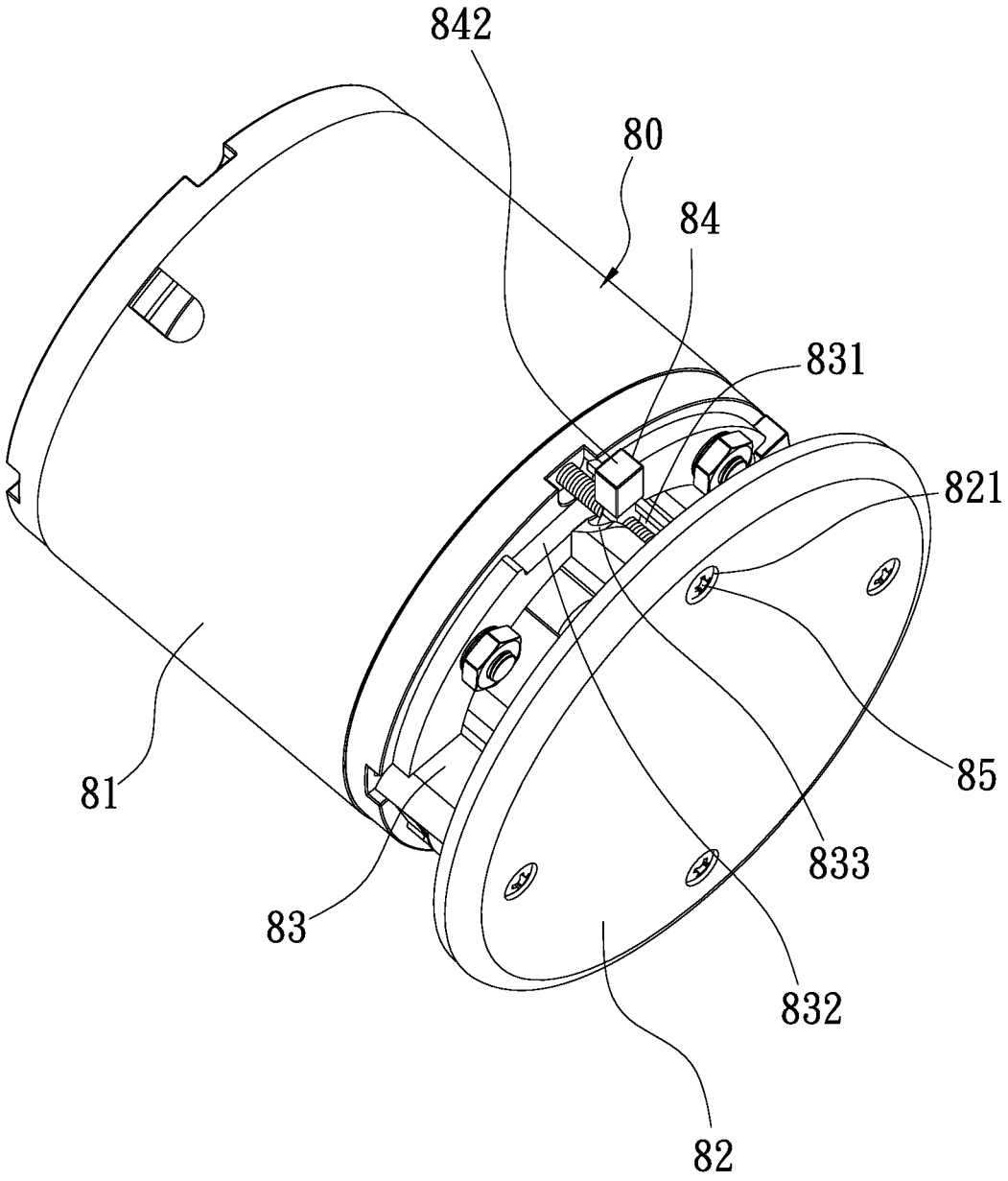
FIG. 15 PRIOR ART
FIG. 15 is also another perspective view showing the installation of the conventional spa sprayer.
Figure 16:
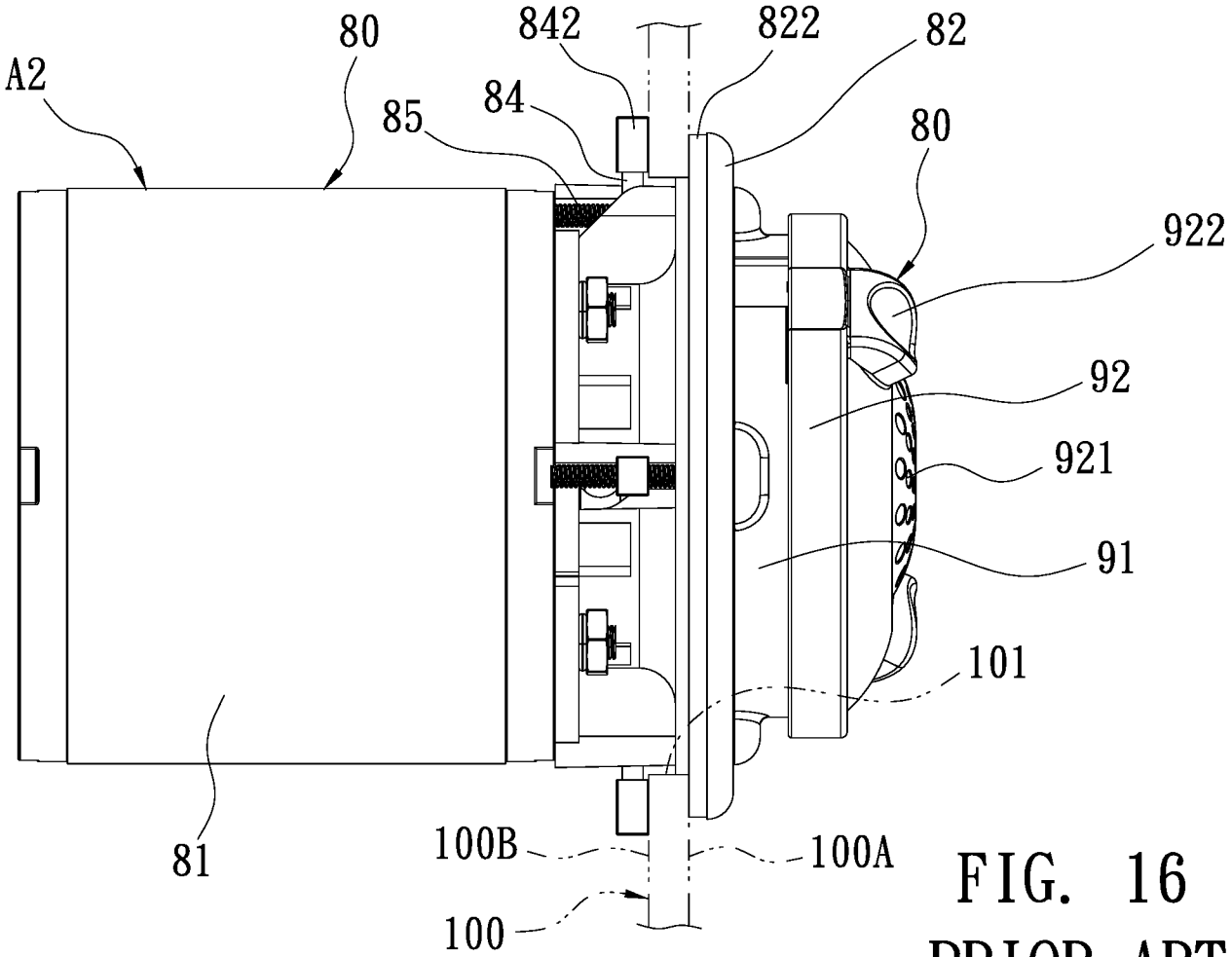
FIG. 16 PRIOR ART
FIG. 16 is a side plan view showing the installation of the conventional spa sprayer.

With reference to FIGS. 1-3, a fixing structure of a spa sprayer according to a preferred embodiment of the present invention, the spa sprayer A1 comprises: a body 10 and a water spray unit 20.

The body 10 includes an insertion segment 10A, a connection segment 10B relative to the insertion segment 10A, a motor 11, a holder 12, an annular positioning section 13 defined between the motor 11 and the holder 12, multiple fixers 14, and multiple bolts 15.

The holder 12 is mounted on the connection segment 10B of the body 10 and has a plurality of orifices 121 defined thereon and passing through the annular positioning portion 13, the holder 12 further has a waterproof washer 122 arranged on a connection area of the holder 12 and the annular positioning portion 13.

The annular positioning section 13 has multiple seats 131 corresponding to the multiple orifices 121 respectively and has a receiving groove 132 away from the holder 12, wherein the multiple seats 131 have a plurality of recesses 1311 defined on middles thereof respectively, and each of the multiple seats 131 has two opposite notches 1312 defined on two sides thereof, wherein each of the two opposite notches 1312 is formed in a ditch shape.

The multiple fixers 14 are fixed on the multiple seats 131 of the annular positioning section 13 individually. Each of the multiple fixers 14 includes a rotation element 141, a drive element 142, and a first rotary shaft 143. The rotation element 141 has a rotatable coupling portion 141A and has an abutting portion 141B bending from the rotatable coupling portion 141A. The rotatable coupling portion 141A has a second rotary shaft 1411 arranged on an end thereof away from the abutting portion 141B, and the rotatable coupling portion 141A has two opposite first apertures 1412 defined between the second rotary shaft 1411 and the abutting portion 141B. The abutting portion 141B has anti-slip patterns 1413 formed thereon. The drive element 142 has a second aperture 1421 and a threaded aperture 1422 perpendicular to the second aperture 1421, and the drive element 142 is secured between the two opposite first apertures 1412. The first rotary shaft 143 is inserted through the two opposite first apertures 1412 and the second aperture 1421 of the drive element 142 to rotatably connect with the drive element 142 and the rotation element 141. The second rotary shaft 1411 of the rotation element 141 is rotatably connected with the two opposite notches 1312 of each seat 131 so as to rotate and slide in the two opposite notches 1312.

The multiple bolts 15 are inserted through the plurality of orifices 121 of the holder 12 to screw with multiple threaded apertures 1422 of plural drive elements 142 of the multiple fixers 14 respectively, and multiple waterproof rings 151 are defined among the multiple bolts 15 and the plurality of orifices 121 of the holder 12 individually.

The water spray unit 20 is fixed on a surface of the holder 12 away from the motor 11. The water spray unit 20 includes a spraying member 21 and a lid 22 connected with the spraying member 21, wherein the lid 22 has plural inlets 221 arranged around a center thereof and has two opposite outlets 222 proximate to a peripheral side of the lid 22.

Referring to FIGS. 4-11, the spa sprayer A1 is mounted on a foot spa tub, and a peripheral wall 100 of the foot spa tub has a front face 100A, a back face 100B opposite to the front face 100A, and multiple holes 101 defined thereon. Plural abutting portions 141B of the rotation elements 141 of the multiple fixers 14 are abutted against the receiving groove 132, the insertion segment 10A of the body 10 is inserted through the multiple holes 101 of the peripheral wall 100 of the foot spa tub, and the waterproof washer 122 of the holder 12 of the body 10 contacts with the front face 100A of the peripheral wall 100. Thereafter, the multiple bolts 15 are rotated tightly by using a tool to respectively drive the plural drive elements 142 of the multiple fixers 14 to move toward the holder 12, wherein the plural drive elements 142 are rotatably connected with the rotation element 141 individually, multiple second rotary shafts 1411 of the rotation element 141 is rotated and slid in a plurality of notches 1312 of the multiple seats 131 respectively, such that the plural drive elements 142 drive the rotation element 141 to revolve individually so that the plural abutting portions 141B of the rotation element 141 rotatably move toward the holder 12 until contacting with the back face 100B of the peripheral wall 100, hence the spa sprayer A1 is retained on the peripheral wall 100 by the plural abutting portions 141B of the rotation element 141 and the waterproof washer 122 of the holder 12, thus avoiding water leakage of the spa sprayer by ways of the waterproof washer 122 and the multiple waterproof rings 151.

Thereby, the spa sprayer of the present invention has advantages as follows:

The multiple bolts 15 are screwed with the multiple threaded apertures 1422 of the plural drive elements 142 of the multiple fixers 14 respectively, and the multiple bolts 15 are rotated tightly to respectively drive the plural drive elements 142 to move toward the holder 12, wherein the plural drive elements 142 are rotatably connected with the plural abutting portions 141B individually, the multiple second rotary shafts 1411 of the rotation element 141 is rotated and slid in the plurality of recesses 1312 of the multiple seats 131 respectively, such that the plural drive elements 142 individually drive the plural abutting portions 141B of the rotation element 141 to rotatably move toward the holder 12, thus retaining the spa sprayer A1 on the peripheral wall 100 of the foot spa tub. The plural abutting portions 141B of the rotation element 141 is rotatably moved quickly to reduce rotations of the multiple bolts 15, thus fixing and removing the spa sprayer easily and quickly and decreasing installation and maintenance costs.

While various embodiments in accordance with the present invention have been shown and described, it is clear to those skilled in the art that further embodiments may be made without departing from the scope of the present invention.

What is claimed is:

1. A fixing structure of a spa sprayer, the spa sprayer comprises comprising:

a body including an insertion segment, a connection segment relative to the insertion segment, a motor, a holder, an annular positioning section defined between the motor and the holder, multiple fixers, and multiple bolts;

the holder mounted on the connection segment of the body and having a plurality of orifices defined on the holder and passing through the annular positioning portion, the annular positioning section having multiple seats corresponding to the multiple orifices respectively and having a receiving groove away from the holder, the multiple seats having a plurality of recesses defined on middles thereof respectively, and each of the multiple seats having two opposite notches defined on two sides thereof, the multiple fixers being fixed on the multiple seats of the annular positioning section individually, each of the multiple fixers including a rotation element, a drive element, and a first rotary shaft;

the rotation element having a rotatable coupling portion and having an abutting portion bending from the rotatable coupling portion, the rotatable coupling portion having a second rotary shaft arranged on an end thereof away from the abutting portion, and the rotatable coupling portion having two opposite first apertures defined between the second rotary shaft and the abutting portion;

the drive element having a second aperture and a threaded aperture, and the drive element being secured between the two opposite first apertures;

the first rotary shaft being inserted through the two opposite first apertures and the second aperture of the drive element to rotatably connect with the drive element and the rotation element, the second rotary shaft of the rotation element being rotatably connected with the two opposite notches of each seat so as to rotate and slide in the two opposite notches, the multiple bolts being inserted through the plurality of orifices of the holder to screw with multiple threaded apertures of plural drive elements of the multiple fixers respectively; and a water spray unit fixed on the holder of the body.

2. The fixing structure as claimed in claim 1, wherein the holder of the body further has a waterproof washer arranged on a connection area of the holder and the annular positioning portion.

3. The fixing structure as claimed in claim 1, wherein each of the two opposite notches is formed in a ditch shape.

4. The fixing structure as claimed in claim 1, wherein the abutting portion has anti-slip patterns formed thereon.

5. The fixing structure as claimed in claim 1, wherein the second aperture of the drive element is perpendicular to the threaded aperture of the drive element.

6. The fixing structure as claimed in claim 1, wherein multiple waterproof rings are defined among the multiple bolts and the plurality of orifices of the holder individually.

7. The fixing structure as claimed in claim 1, wherein the water spray unit is fixed on a surface of the holder away from the motor, and the water spray unit includes a spraying member and a lid connected with the spraying member, wherein the lid has plural inlets arranged around a center thereof and has two opposite outlets proximate to a peripheral side of the lid.

* * * * *